US005311661A

United States Patent [19]

Zifferer

[11] Patent Number: 5,311,661

[45] Date of Patent: May 17, 1994

[54] METHOD OF POINTING AND CORRUGATING HEAT EXCHANGE TUBING

[75] Inventor: Lothar R. Zifferer, Waco, Tex.

[73] Assignee: Packless Metal Hose Inc., Waco, Tex.

[21] Appl. No.: 962,660

[22] Filed: Oct. 19, 1992

[51] Int. Cl.[5] ..... B23P 15/00

[52] U.S. Cl. ..... 29/890.053; 29/890.05

[58] Field of Search ..... 29/890.05, 890.053; 72/267, 377, 467

[56] References Cited

U.S. PATENT DOCUMENTS

| | | | |
|---|---|---|---|
| 2,337,490 | 12/1943 | Penner | 29/890.05 |
| 2,667,650 | 2/1954 | Friedman | 72/377 |
| 2,733,503 | 2/1956 | Beringer et al. | 72/377 |
| 3,292,414 | 12/1966 | Gocke | 29/890.053 |
| 3,863,526 | 2/1975 | Sygnator | 72/377 |
| 4,031,745 | 6/1977 | McCarty | 29/890.053 |
| 4,672,834 | 6/1987 | Abberto | 29/890.05 |

FOREIGN PATENT DOCUMENTS

| | | | |
|---|---|---|---|
| 731354 | 4/1966 | Canada | 29/890.05 |
| 0144460 | 6/1985 | European Pat. Off. | 2/890.05 |

*Primary Examiner*—Irene Coda
*Attorney, Agent, or Firm*—Neal J. Mosely

[57] ABSTRACT

A method for producing corrugated tubes of substantially high surface area for use in tube-in-shell heat exchangers which are particularly efficient for cooling water involves pointing a heat exchange tube at both ends to reduce the diameter substantially and increase the wall thickness of the pointed ends and then corrugating the tubes linearly. The tubes each having intermediate portions linearly corrugated to provide equally spaced deep corrugations extending in a straight line parallel to the axis of the tubes. The corrugations, which are equivalent to tubes, multiply the amount of heat transfer attainable from the point diameter selected for attachment to the tube sheets. The ratio of the surface area of the corrugated body portion to the surface areas of said reduced ends, per unit length, is in the range from about 1.5:1 to about 4:1. It also makes possible the contiguous relation of each tube to the surrounding tubes. The nesting of the tubes in a heat exchanger minimizes by-pass of the fluid and controls the velocity essential to achieving turbulent flow and attendant high rates of heat transfer.

10 Claims, 4 Drawing Sheets

METHOD OF POINTING AND CORRUGATING HEAT EXCHANGE TUBING

FIELD OF THE INVENTION

This invention relates to new and useful improvements in manufacturing heat exchange tubing and more particularly to methods of pointing and corrugating tubing for use in tube-in-shell heat exchangers.

BRIEF DESCRIPTION OF THE PRIOR ART

Tube-in-shell heat exchangers have been in use for many years. There have been many efforts to improve such heat exchangers, particularly for use in cooling water.

Dewey U.S. Pat. No. 2,365,688 discloses a tube-in-shell heat exchanger which groups or arranges the tubes for economical use of the available space and at the same time provides for an extended surface for heat exchange without blocking free circulation of a fluid between the tubes.

Donovan U.S. Pat. No. 2,797,554 discloses a tube-in-shell heat exchanger having longitudinally finned tubes extending through longitudinally extending tubes in the outer heat exchange shell.

Brown et al. U.S. Pat. No. 2,342,117 discloses a heat exchange tube having longitudinally extending fins secured thereon.

Brown U.S. Pat. No. 2,499,901 discloses a tube-in-shell heat exchanger with heat exchange tubes extending longitudinally therein with longitudinally extending heat exchange fins secured thereon.

Legrand U.S. Pat. No. 3,046,818 discloses a tube-in-tube heat exchanger with heat exchange tubes extending longitudinally in an outer tube with longitudinally extending heat exchange fins formed from the walls of the inner tubing.

Andersson U.S. Pat. No. 4,162,702 discloses a tube-in-shell heat exchanger with heat exchange tubes extending longitudinally therein with longitudinally extending heat exchange fins secured thereon, the space between the tubes and the shell being closed by filler material.

Shepherd et al U.S. Pat. No. 4,377,083 discloses the formation of helically corrugated tubing wherein tubing is drawn through a rotating die.

Zifferer U.S. Pat. No. 4,514,997 discloses the formation of helically corrugated tubing wherein tubing is drawn through a rotating die.

Singer U.S. Pat. No. 2,110,965 discloses a method of reducing the diameter of tubing by drawing it through a die.

Schmidt U.S. Pat. No. 2,378,729 discloses a method of reducing the diameter of and cold working magnesium alloy tubing by drawing it through a die.

Ceccacci U.S. Pat. No. 4,383,429 discloses an apparatus for forming a point on the end of a tube by means of a drawing operation which indents the reduced diameter peripherally.

SUMMARY OF THE INVENTION

One of the objects of this invention is to provide a new and improved method for producing heat exchange tubing for use in tube-in-shell heat exchangers having improved heat exchange and improved fluid flow around the heat exchange tubes.

Another object of this invention is to provide a new and improved method for producing heat exchange tubing for use in tube-in-shell heat exchangers having improved heat exchange and improved fluid flow around the heat exchange tubes in which the heat exchange tubes are linearly corrugated around the circumference of each tube.

Another object of this invention is to provide a new and improved method for producing heat exchange tubing for use in tube-in-shell heat exchangers having improved heat exchange and improved fluid flow around the heat exchange tubes in which the heat exchange tubes are linearly corrugated around the circumference of each tube to provide uniformly spaced hollow heat exchange fins extending linearly of each tube.

Another object of this invention is to provide a new and improved method for producing heat exchange tubing for use in tube-in-shell heat exchangers having improved heat exchange and improved fluid flow around the heat exchange tubes in which the heat exchange tubes are pointed at each end by reduction in a die to a diameter substantially smaller than the initial diameter and proportionately thicker, to facilitate installation in the tube plates of a heat exchanger, and then linearly corrugated around the circumference of the tube to provide uniformly spaced hollow heat exchange fins extending linearly of each tube.

Another object of this invention is to provide a new and improved method for producing heat exchange tubing for use in tube-in-shell heat exchangers having improved heat exchange and improved fluid flow around the heat exchange tubes in which the heat exchange tubes are pointed at each end by reduction in a die to a diameter substantially smaller than the initial diameter and proportionately thicker, to facilitate installation in the tube plates of a heat exchanger, and then linearly corrugated around the circumference of the tube to provide a plurality of passages having a surface area for heat exchange substantially greater than the uncorrugated tubing.

Another object of this invention is to provide a new and improved method for producing heat exchange tubing for use in tube-in-shell heat exchangers having improved heat exchange and improved fluid flow around the heat exchange tubes in which the heat exchange tubes are pointed at each end by reduction in a die to a diameter substantially smaller than the initial diameter and proportionately thicker, to facilitate installation in the tube plates of a heat exchanger, and then linearly corrugated around the circumference of the tube by a linear corrugating die having four or six die teeth, to provide a plurality of, e.g., four or six, passages having a surface area for heat exchange substantially greater than the uncorrugated tubing.

Still another object of this invention is to provide a new and improved heat exchange tube for a tube-in-shell heat exchanger having each end pointed by reduction in a die to a diameter substantially smaller than the initial diameter and proportionately thicker, to facilitate installation in the tube plates of a heat exchanger, and then linearly corrugated around the circumference of the tube to provide a plurality of passages having a surface area for heat exchange substantially greater than the uncorrugated tubing.

Stiff another object of this invention is to provide a new and improved heat exchange tube for a tube-in-shell heat exchanger having opposite ends pointed simultaneously by reduction in a pair of dies to a diameter substantially smaller than the initial diameter and proportionately thicker, to facilitate installation in the tube plates of a heat exchanger, and then linearly corrugated around the circumference of the tube to provide a plurality of passages having a surface area for heat exchange substantially greater than the uncorrugated tubing.

Other objects of the invention will become apparent from time to time throughout the specification and claims as hereinafter related.

DESCRIPTION OF ONE PREFERRED EMBODIMENT

This invention relates to new and useful improvements in methods and apparatus for producing corrugated tubes of substantially higher surface area for use in tube-in-shell heat exchangers which are particularly efficient for cooling water. The method involves pointing a heat exchange tube at both ends to reduce the diameter substantially and increase the wall thickness of the pointed ends and then corrugating the tubes linearly.

Figure 1:
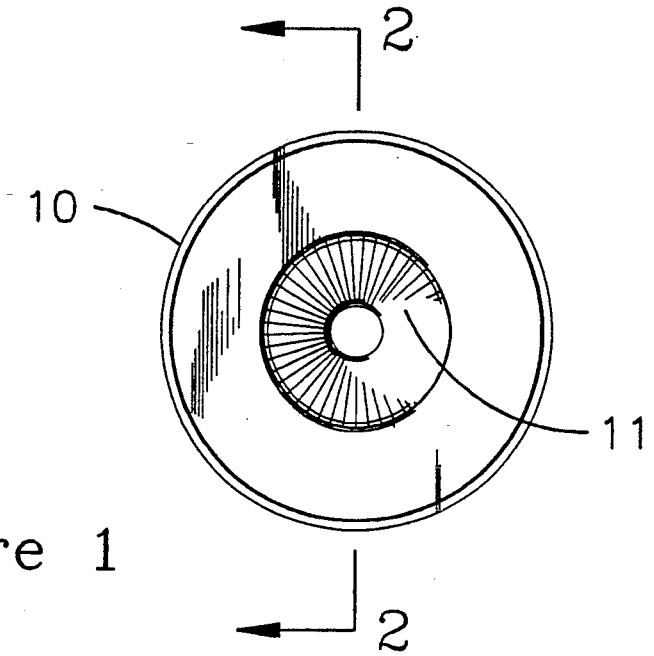
FIG. 1 is an end view in elevation of a tube pointing die for use in a preferred embodiment of the invention.
Figure 2:
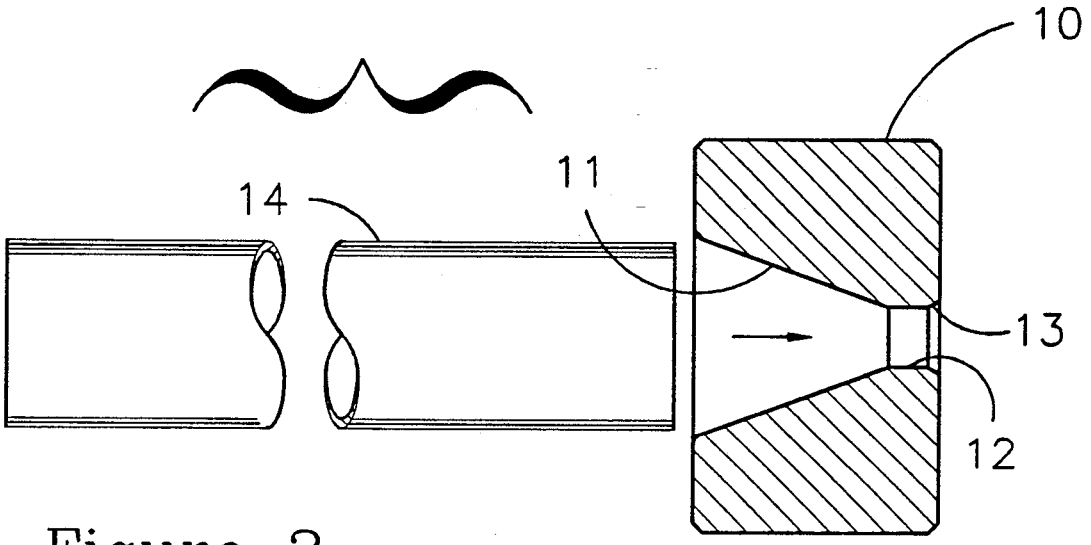
FIG. 2 is a view in cross section taken on the line 2—2 of FIG. 1 of the tube pointing die with a tube about to enter the die for reduction or pointing of the end.
Figure 4:
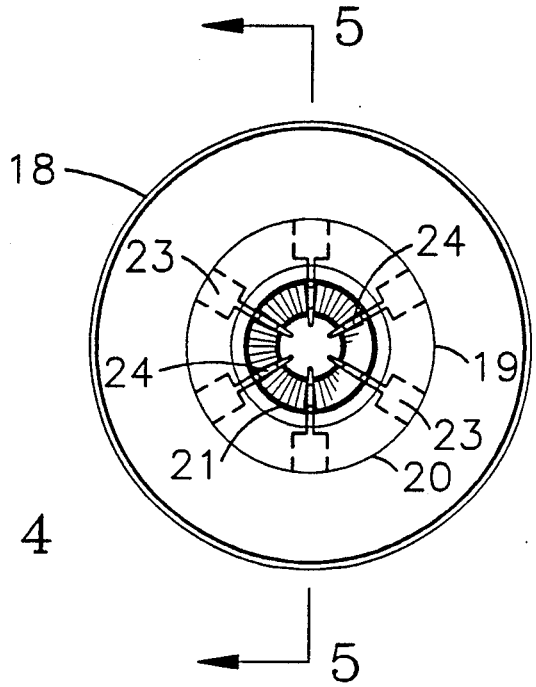
FIG. 4 is an end view in elevation of a tube corrugating die for producing linear corrugations in a heat exchange tube in accordance with a preferred embodiment of the invention.

In FIG. 1, there is shown an end view of a tube pointing die 10 which is cylindrical in shape and has a conical die surface 11 leading to a small cylindrical opening 12 (FIG. 2) chamfered at 13 on the rear face. The die 10 is preferably of stainless steel although any suitable die alloy can be used. A length of heat exchange tubing 14 is shown in FIG. 4 in position to begin pointing of the ends thereof. The tube is a high heat transfer material such as copper, brass, bronze or aluminum.

Tube 14 is slowly pressed, under mechanical or hydraulic pressure, into die 10 where it is gradually reduced in diameter until a selected length of the end passes through cylindrical opening 12 in the die. The tube 14 is then withdrawn from the die 10 and the other end pressed into the die until it is similarly reduced in diameter. In a preferred commercial embodiment, the dies 10 are movable and two dies are spaced apart by about the length of the tube being pointed so that the dies are simultaneously moved against opposite ends to the tube to form the redused or pointed ends 15 of opposite ends of the tube simultaneously. The reduction in diameter of tube 14 under the confinement of die 10 causes the ends to increase in wall thickness to take up the material of the tubing wall as in is reduced in diameter.

Figure 3:
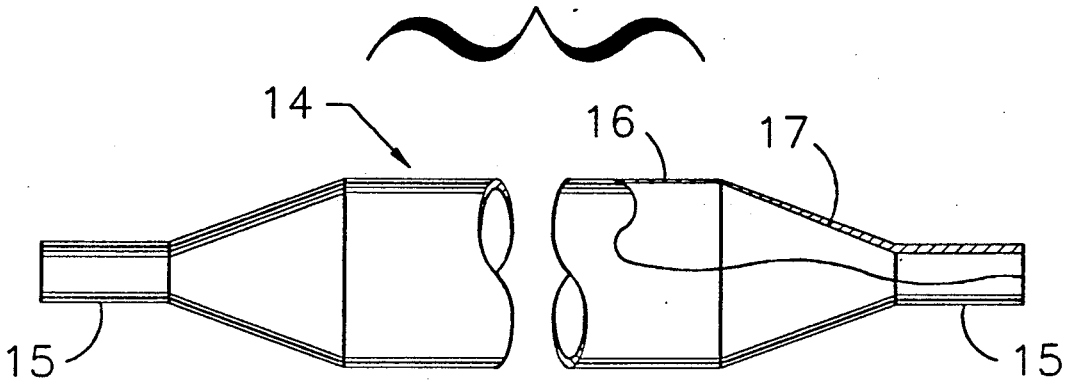
FIG. 3 is a view, in elevation, of a tube pointed at both ends by the die shown in FIGS. 1 and 2.

The tube 14 with ends 15 reduced in diameter is shown in FIG. 3. The broken section at the right side of FIG. 3 shows the gradual change in wall thickness from the portion 16 which is the initial wall thickness of the tube, through the portion 17 where the wall thickness is gradually increasing, to the end 15 where the wail thickness has increased to an amount which is thicker by approximately the same proportion as the reduction in diameter of the end 15. For example, a 1.187" O.D. tube having a wall thickness of 0.020" which has its end portion 15 reduced to 0.375" O.D. will have a wall thickness of 0.055" while the main body 16 of the tube remains unchanged at a wail thickness of 0.020" with portion 17 tapering in wail thickness. The heavier wall thickness of the ends 15 increases the integrity of the joint when the ends are assembled in tube sheets in a tube-in-shell heat exchanger.

In FIG. 4, there is shown an end view of a tube corrugating die 18 which is cylindrical in shape and has a conical surface 19 leading from an entrance opening 19 to an exit opening 20. A die insert 22 has an exterior surface which fits the conical surface 19 of die block 18. Die insert 22 has a plurality of slots 23 which house die teeth 24 and hold them tightly in place in die block 18. This dies is shown with six die teeth 24 but other numbers could be used. The use of six die teeth 24 permit hexagonal packing of the corrugated tubing while the use of four die teeth permits square packing of the corrugated tubing. The die teeth 24 project only slightly at their entrance ends 25 and gradually increase in projection to their exit ends 26 which define an opening which just clears the surface of end portion 15 of tube 14.

Figure 5:
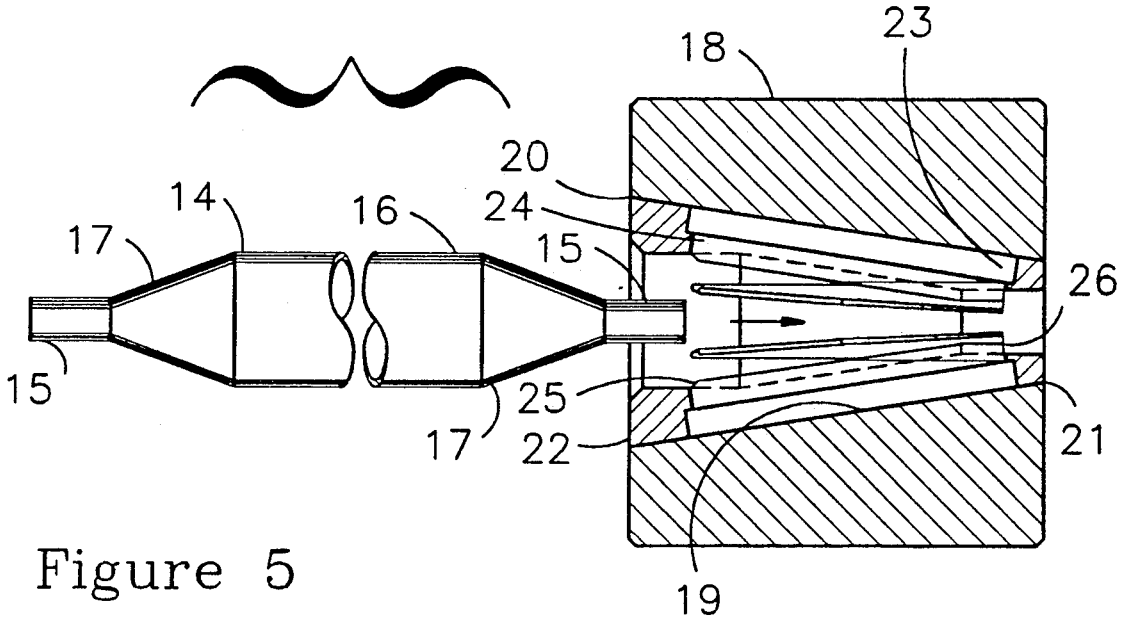
FIG. 5 is a view in cross section taken on the line 5—5 of FIG. 4 of the tube corrugating die with a tube about to enter the die for producing linear corrugations therein.
Figure 6:
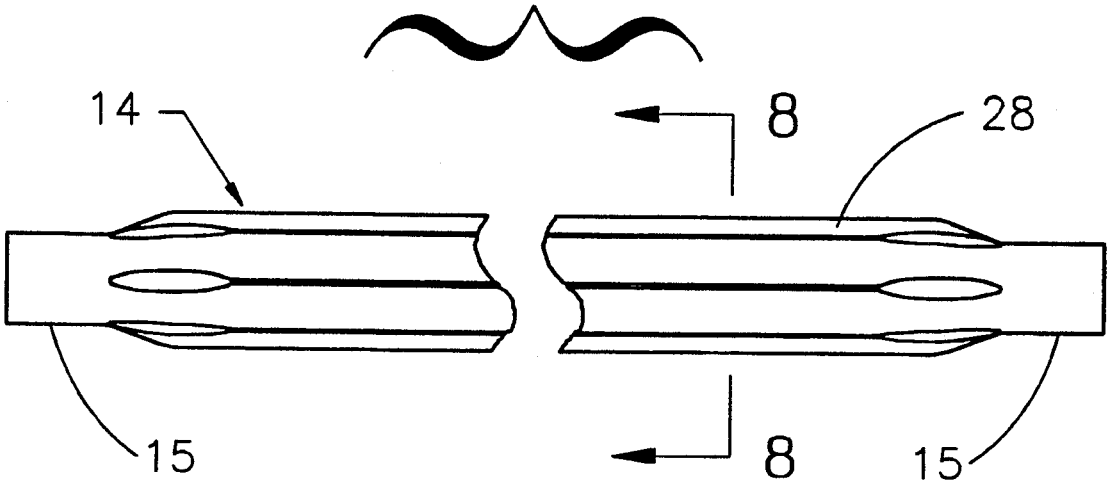
FIG. 6 is a view, in elevation, of a tube pointed at both ends and corrugated (six corrugations) linearly by the dies shown in FIGS. 1, 2, 4 and 5 having six die teeth.
Figure 7:
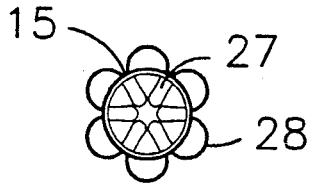
FIG. 7 is an end view in elevation of the pointed and corrugated tube shown in FIG. 6.
Figure 8:
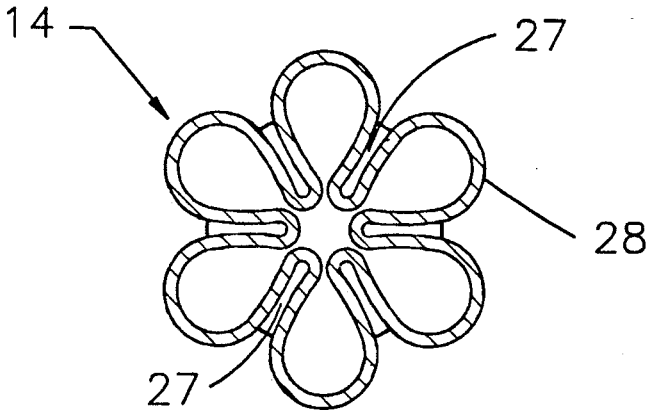
FIG. 8 is a is a view in cross section taken on the line 8—8 of FIG. 6.

Tube 14, with pointed ends 15 (FIGS. 3 and 5), is shown with one end 15 about to enter the corrugating die 18. A pusher rod (not shown) having the same O.D. as tube ends 15 pushes the tube through the die 18 where the die teeth 24 indent the tube uniformly around its periphery and gradually increase the depth of the indentations until the tube has corrugations configured as seen in FIGS. 6–8. While the exit end opening from the die teeth 24 clears the pointed ends 15 of the tubes 14, the wails of the tube are actually indented further than the I.D. of the tube. Thus, tube 14, in this embodiment, is corrugated by six equally spaced die teeth 24 which produces six indentations 27 which define corrugations 28 extending linearly of the tub in a tightly nested configuration, the inner ends of the indentations 27 terminating at or inside the I.D. of tube ends 15.

Figure 9:
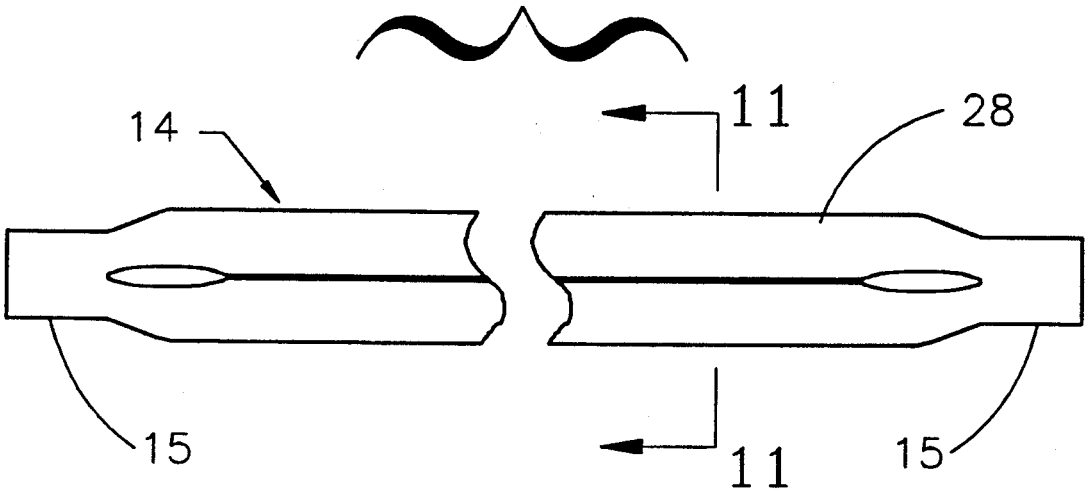
FIG. 9 is a view, in elevation, of a tube pointed at both ends and corrugated (four corrugations) linearly by the dies shown in FIGS. 1, 2, 4 and 5 having four die teeth.
Figure 10:
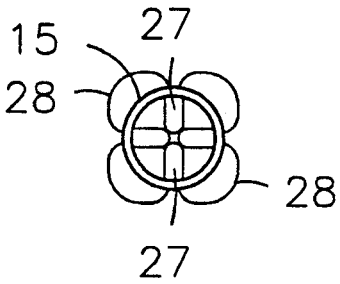
FIG. 10 is an end view in elevation of the pointed and corrugated tube shown in FIG. 9.
Figure 11:
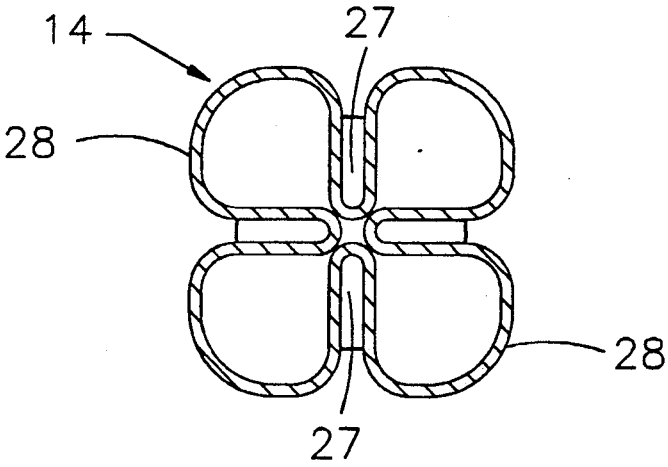
FIG. 11 is a is a view in cross section taken on the line 11—11 of FIG. 9.

In FIGS. 6–8, there are shown details of the tubing corrugated with six linear corrugations which will nest in a hexagonal pattern. In FIGS. 9–11 there are shown details of the tubing which has been corrugated by a die with four die teeth and has four corrugations with the indentations projecting substantially inside the I.D. of the pointed ends 15. This tubing, with four corrugations, win nest in a square pattern and fit inside a square cross-section shell without requiring any fillers to prevent cross circulation of the fluid in the heat exchanger using the tubes.

It is to be notes that while the tube pointing operation increases the wall thickness of the ends, the convolution of the tube wall does not thicken it. The convoluting rearranges the metal in a folding operation while the pointing operation is an extrusion type of metal displacement in which both wall thickening and length extrusion of the point occur.

The corrugated tubes 14 produced herein are used in a tube-in-shell heat exchanger described and shown in my copending application Ser. No. 07/96,266, filed Oct. 19, 1992, wherein a hollow tubular shell has header plates or caps welded or brazed thereon. The header plates have an inlet opening and an outlet opening for conducting water (or other fluid) therethrough. Tube plates are welded or brazed to the inlet and outlet ends of the shell. The heat exchange tubes 14 of this invention are positioned with the reduced, and thickened, ends 15 fitting and secured in the openings in the tube plates to provide a rigid connection. The outer walls of the linearly corrugated tubes are nested together and define linear passages through and around the linear corrugations without cross flow in the heat exchanger. The heat exchanger, as just described, is designed as a water chiller or cooler for cooling large quantities of flowing water and is connected in a water line with water entering the inlet and exiting from the outlet. The water is confined at the inlet end by the tube plate to flow through the interior of tubes 14. The apparatus is also connected in a refrigeration system and constitutes the evaporator for the system. Liquified refrigerant enters through an inlet, flows through passages around the tubes 14 as it evaporates and exits through the outlet from the heat exchanger. Alteratively, the refrigeration system may cool a secondary refrigerant fluid at another location and circulate it through this water chiller.

The ideal shell and tube heat exchanger would have the largest number of smallest tubes (but larger than capillary size) that can be expanded and sealed into a tube sheet. This ideal heat exchanger would eliminate the need for baffles to control flow at right angles to the tubes. However, there is a practical limit to downsizing tubes because of the labor to install, expand and seal the tubes.

The tubes 14 effectively multiply, by means of the lobes (corrugations), which are equivalent to tubes, the amount of heat transfer attainable from the point diameter selected for attachment to the tube sheets. It also makes possible the contiguous relation of each tube to the surrounding tubes. The nesting of the tubes in the heat exchanger minimizes by-pass of the fluid and controls the velocity essential to achieving turbulent flow and attendant high rates of heat transfer.

The heavy wail point and thin wan of the heat transfer tube are unique features which contribute importantly to the economy of materials used in this type of heat exchanger. The attainable heat transfer per unit of length in relation to point size is extremely high with linearly convoluted tubes.

As an example: A 1.187" diameter tube can be pointed to 0.375" diameter and the main body of the tube convoluted to 0.562" diameter. These tubes are nested in contact with each other to maximize the total area available for heat transfer. Whereas a conventional tube point is equal to the tube diameter for a 1:1 ratio. The ratio of the tube to the point is the design just described is 3.16:1, although ratios in the range from about 1.5:1 to 4:1 are effective.

While this invention has been described fully and completely with special emphasis on certain preferred embodiments, it should be understood that within the scope of the appended claims the invention may be practiced otherwise than as specifically described.

I claim:

1. A method of producing a high surface area tube for use in tube-in-shell heat exchange apparatus comprising providing a thin wall heat exchange tube of selected length and wall thickness facilitating a high heat transfer rate, providing at least one tapered tube pointing die of selected size and smooth conical taper having a large entrance end and a small cylindrical exit opening, pointing said tube by the steps of first forcing the ends of said tube into said tube pointing die to substantially reduce the diameter uniformly to enter said exit opening and correspondingly increase the wall thickness of a selected length of said ends, and said tube pointing thus producing a tube having uncorrugated smooth cylindrical ends of substantially reduced diameter and increased wall thickness suitable for securing in the tube sheet of a tube-in-shell heat exchanger and a main unreduced cylindrical body portion which is of the initial wall thickness and tapering at each end in a smooth conical taper to the increased thickness of said end, and then linearly corrugating said main body portion along substantially its entire length to produce a smaller diameter portion with linear corrugations extending along substantially the entire length of said main body portion and terminating at said tapered end portions adjacent to said reduced diameter smooth cylindrical end portions and thus providing a surface area for heat transfer which is substantially greater than the surface area said ends.

2. A method according to claim 1 in which said tube reducing step is performed simultaneously at both ends.

3. A method according to claim 1 in which said tube is copper, brass, bronze, or aluminum.

4. A method according to claim 1 in which said linear corrugating is performed by providing a tapered tube corrugating die with uniformly spaced die teeth around the inner periphery thereof and a rear exit opening, said die teeth projecting only slightly above the surface of the inlet to the die and increasing in projection above the die surface toward the rear, forcing one cylindrical reduced end of said tube into said tube corrugating die and out through the exit opening therefrom to cause said die teeth to indent and corrugate said tube main body portion into a plurality of equally spaced linear corrugations extending along substantially the entire length thereof.

5. A method according to claim 1 in which said linear corrugating is performed by providing a tapered tube corrugating die with uniformly spaced die teeth around the inner periphery thereof and a rear exit opening, said die teeth projecting only slightly above the surface of the inlet to the die and increasing in projection above the die surface toward the rear and at the point of greatest projection being spaced to clear said tube reduced ends, forcing one cylindrical reduced end of said tube into said tube convoluting die and out through the exit opening therefrom to cause said die teeth to indent and corrugate said tube main body portion into a plurality of equally spaced linear corrugations extending along substantially the entire length thereof.

6. A method according to claim 5 in which said tube corrugating die has said equally spaced die teeth projecting sufficiently above the surface of the die to produce corrugations in the wall of the tube projecting inward to about the diameter of said cylindrical reduced ends.

7. A method according to claim 5 in which said tube corrugating die has said equally spaced die teeth projecting sufficiently above the surface of the die to produce corrugations in the wall of the tube projecting inside the diameter of said reduced ends.

8. A method according to claim 5 in which said tube corrugating die has four equally spaced die teeth and said tube has four corrugations produced thereby.

9. A method according to claim 5 in which said tube corrugating die has six equally spaced die teeth and said tube has six corrugations produced thereby.

10. A method according to claim 5 in which said tube corrugating die has six equally spaced die teeth and said tube has six corrugations produced thereby, and the ratio of the surface area of the corrugated body portion to the surface areas of said cylindrical reduced ends, per unit length, is in the range from about 1.5:1 to about 4:1.

* * * * *